US006092802A

United States Patent [19]

Lackner et al.

[11] Patent Number: 6,092,802

[45] Date of Patent: Jul. 25, 2000

[54] PROCESS FOR THE MANUFACTURE OF PRINTED PRODUCTS AND AN ARRANGEMENT FOR IMPLEMENTING THIS PROCESS

[75] Inventors: Joachim Lackner, Thalwil; Marcel Strauss, Sursee, both of Switzerland

[73] Assignee: Grapha-Holding AG, Switzerland

[21] Appl. No.: 09/035,831

[22] Filed: Mar. 6, 1998

[30] Foreign Application Priority Data

Mar. 6, 1997 [CH] Switzerland ..... 0531/97

[51] Int. Cl.[7] ..... B65H 5/00

[52] U.S. Cl. ..... 271/225; 271/184; 271/185; 83/408; 83/155.1

[58] Field of Search ..... 271/9.13, 225, 271/184, 185, 279, 298, 303; 83/408, 155.1

[56] References Cited

U.S. PATENT DOCUMENTS

| | | | |
|---|---|---|---|
| 3,667,753 | 6/1972 | Norton . | |
| 4,030,723 | 6/1977 | Irvine et al. . | |
| 4,371,157 | 2/1983 | Hunt et al. | 271/2 |
| 4,832,327 | 5/1989 | Johansson | 83/155.1 X |
| 4,869,485 | 9/1989 | Enix | 271/2 |
| 5,040,781 | 8/1991 | Matoba . | |
| 5,374,053 | 12/1994 | Doucet et al. . | |
| 5,439,208 | 8/1995 | Moser et al. | 271/225 |
| 5,538,240 | 7/1996 | Auerbach et al. . | |

FOREIGN PATENT DOCUMENTS

| | | |
|---|---|---|
| 0 718 226 A1 | 6/1996 | European Pat. Off. . |
| 41 22 214 A1 | 1/1993 | Germany . |
| 42 42 542 A1 | 6/1994 | Germany . |

*Primary Examiner*—David H. Bollinger
*Attorney, Agent, or Firm*—Venable; George H. Spencer; Robert Kinberg

[57] ABSTRACT

A process for manufacturing printed products from a web of paper printed on according to a predetermined page sequence and subsequently cut crosswise, or crosswise and lengthwise to form individual sheets which can be optionally turned by 90°, relative to their position, on a continued conveying route. The individual sheets are supplied one after another in one or several rows and via a joint conveying segment to a location for further processing. An arrangement for implementing the process includes a cutting device that follows a printing machine and is connected for effectively conveying to a further processing arrangement. A downstream end of a conveying route between the cutting device and the further processing arrangement has a conveying segment into which two conveying routes discharge. The two conveying routes are separated by a diverter. One of the conveying routes is designed for deflecting and the other for turning over the individual sheets with a simultaneous change in the conveying direction.

16 Claims, 4 Drawing Sheets

PROCESS FOR THE MANUFACTURE OF PRINTED PRODUCTS AND AN ARRANGEMENT FOR IMPLEMENTING THIS PROCESS

CROSS-REFERENCE TO RELATED APPLICATIONS

This application claims the right of priority of Swiss application No. 1997 0531/97 filed in Switzerland on Mar. 6, 1997, the disclosure of which is incorporated herein by reference.

BACKGROUND OF THE INVENTION

The invention concerns a process for the manufacture of printed products such as books, booklets or the like by printing on webs of paper or plastic, in accordance with a predetermined sequence of pages for a printed product, as well as the crosswise or the crosswise and lengthwise cutting of the web into individual sheets, such that they can be processed further.

Such a process particularly concerns the printing of books and booklets in smaller series.

A digital printing system for the processing of sheets, which becomes uneconomical for editions exceeding more than approximately 500 copies, and the offset printing process, used for printing editions of approximately 2500 copies and more, leaves a gap for a more economical production with a digital printing system starting with webs.

A known digital printing system by the company NIPSON Printing Systems GmbH, exhibited during the DRUPA' 95, at Dusseldorf (Germany) which is suitable for the initially described process, can print on a paper web with a maximum speed of 60 m/minute, so that a capacity of one hundred bound books per hour is possible. A cutting device and a book binding machine in this order are installed downstream of the printing system. Further processing options are known to include folding, stacking, wire-stitching, etc.

Digital printing systems belong to the group of printing systems where paper is printed on or processed in a predetermined page sequence.

The known processing of a web from a roll of paper does not permit a production with variable formats during a continuous processing path. That is to say the specific format size of an end product respectively depends on the width of the web that is used, or the web width must correspond to the format of the printed product that is produced.

To obtain a format variety, offset processing uses folding devices which do not permit a continuous processing to the end product. Above all, this concerns a folding device that requires different exits, or discharge areas, when processing printed products that are folded in different ways. A folding device with several discharge areas is not suitable for economical processing because this would require an additional high technical expenditure in order to transport all processed products to a joint delivery location from which they can be processed further. This is particularly true for an on-line processing of webs printed on with a predetermined page sequence.

SUMMARY OF THE INVENTION

Thus, it is an object of the invention to create a process of the aforementioned type and an arrangement for implementing it, which do not have the above-mentioned disadvantages and permit an on-line processing of paper webs to obtain variable format sizes for the printed products.

The above and other objects are accomplished in the context of a process for manufacturing printed products including: printing on a web of paper in accordance with a predetermined page sequence for the printed product, the web being fed in a feeding direction; at least one of a) crosswise and b) crosswise and lengthwise cutting of the web into individual sheets; and conveying the cut sheets on a continued conveying route for further processing; wherein according to the invention the process further includes: selectively turning the individual sheets cut from the web by 90° in position relative to the feeding direction of the web; and conveying the cut sheets one after another, in one or several rows, via a joint conveying segment of the continued conveying route to a further processing location.

According to a further aspect of the invention there is provided an arrangement for implementing the above process, the arrangement including: a cutting device for selectively cutting the paper one of a) crosswise, and b) crosswise and lengthwise, and installed after a printing machine supplied with a paper web, the cutting device being connected for conveying the cut sheets for processing by a further processing device; a diverter located upstream on the conveying route for forming two conveying routes which discharge into a downstream conveying segment of the continued conveying route; first means in one of the two conveying routes for deflecting movement of the individual sheets 90° relative to the feed direction; and second means in the other conveying route of the two conveying routes for turning over the individual sheets with a simultaneous change in the conveying direction. According to another aspect of the invention, the individual sheets are cut several times lengthwise.

The invention is explained in detail below in connection with the accompanying drawings.

DETAILED DESCRIPTION OF THE INVENTION

FIGS. 1 to 4 show the processing of a fixed web 1 of paper or plastic that is supplied by a printing machine (not visible) to an arrangement according to the invention. The arrow Z illustrates a feeding direction of web 1, and the dashed lines on web 1 illustrate intended cuts, either crosswise or crosswise and lengthwise, for cutting the web 1 into individual sheets.

Figure 1:
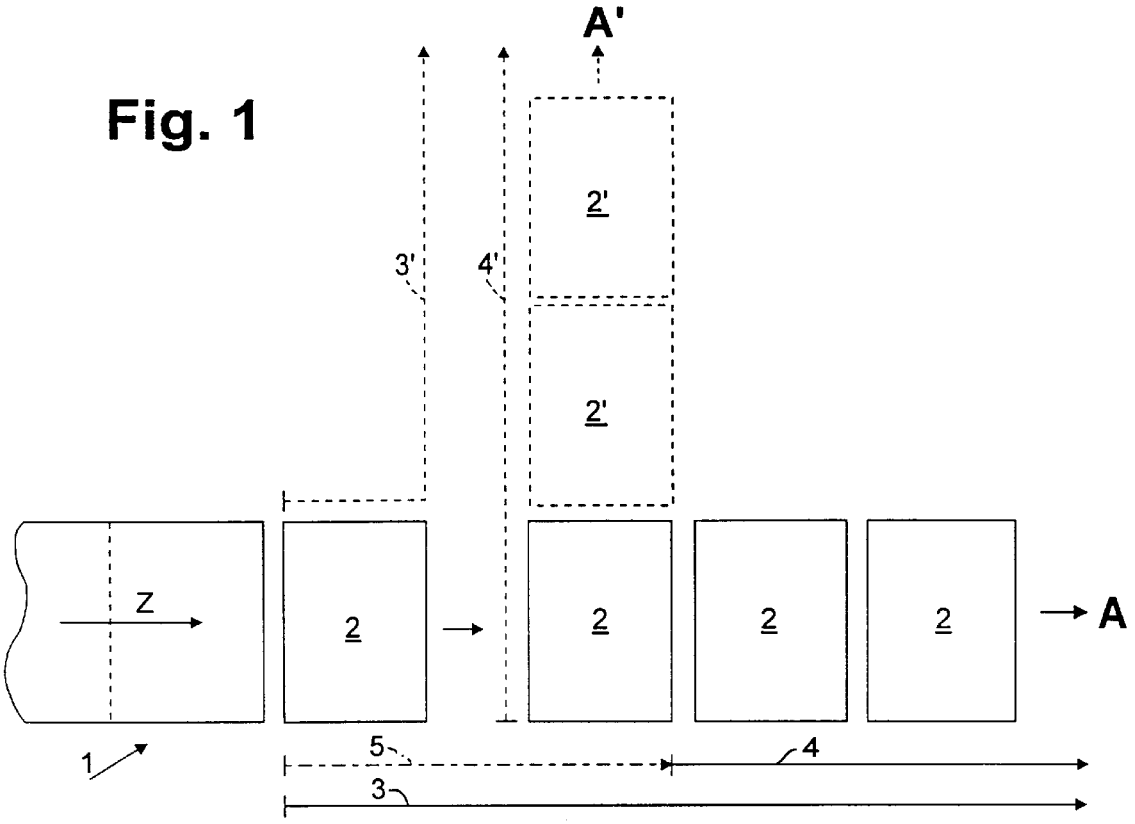
FIG. 1 is a diagrammatic illustration of the process according to the invention during the processing of a paper web cut crosswise into individual sheets.

FIG. 1 illustrates how web 1 is initially separated into individual sheets 2 by cutting it crosswise. During the continued conveying route, in the direction of a further processing location A, individual sheets 2 maintain their position and are conveyed one after another, in a single row, on a joint conveying segment 4 of the continued conveying route 3. Alternatively, individual sheets 2 can be displaced onto a conveying segment 4' by deflecting it at a 90° angle from the feeding direction. The continued conveying route 3' is also at a 90° angle.

Figure 2:
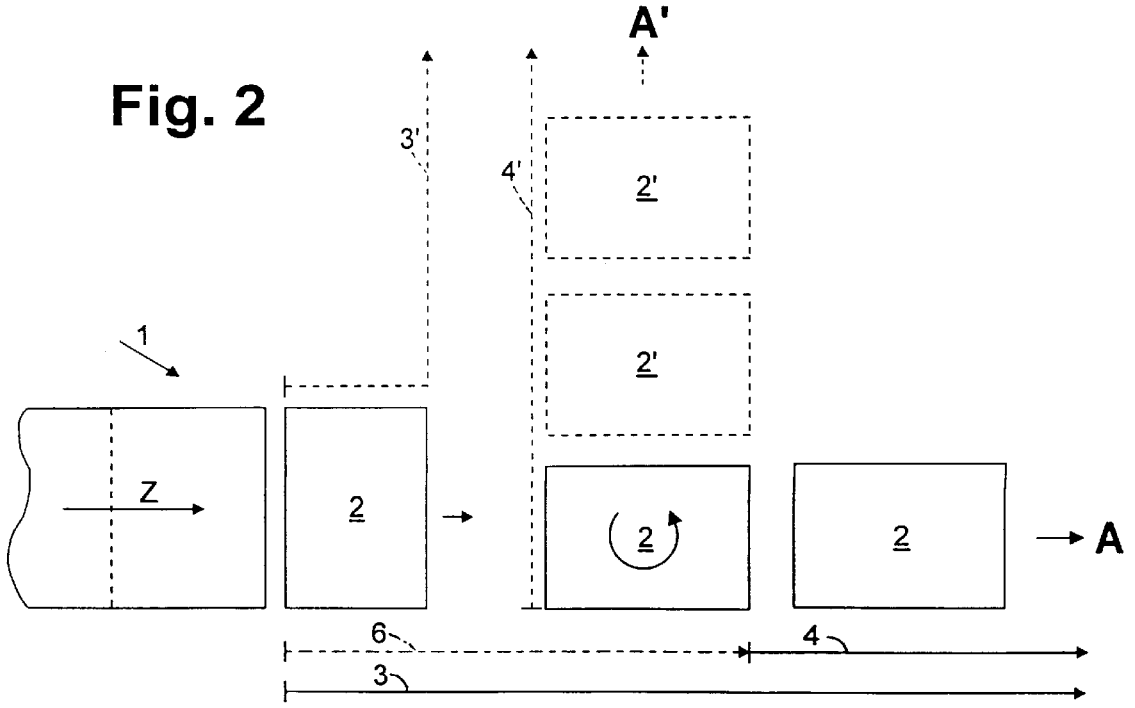
FIG. 2 is a diagrammatic illustration of an alternative course of action for the processing of a paper web cut crosswise into individual sheets.

In contrast to FIG. 1, FIG. 2 illustrates a type of processing, for which the crosswise cut individual sheets 2 are turned in their position by 90° and are subsequently conveyed, one after another, in a row.

Figure 3:
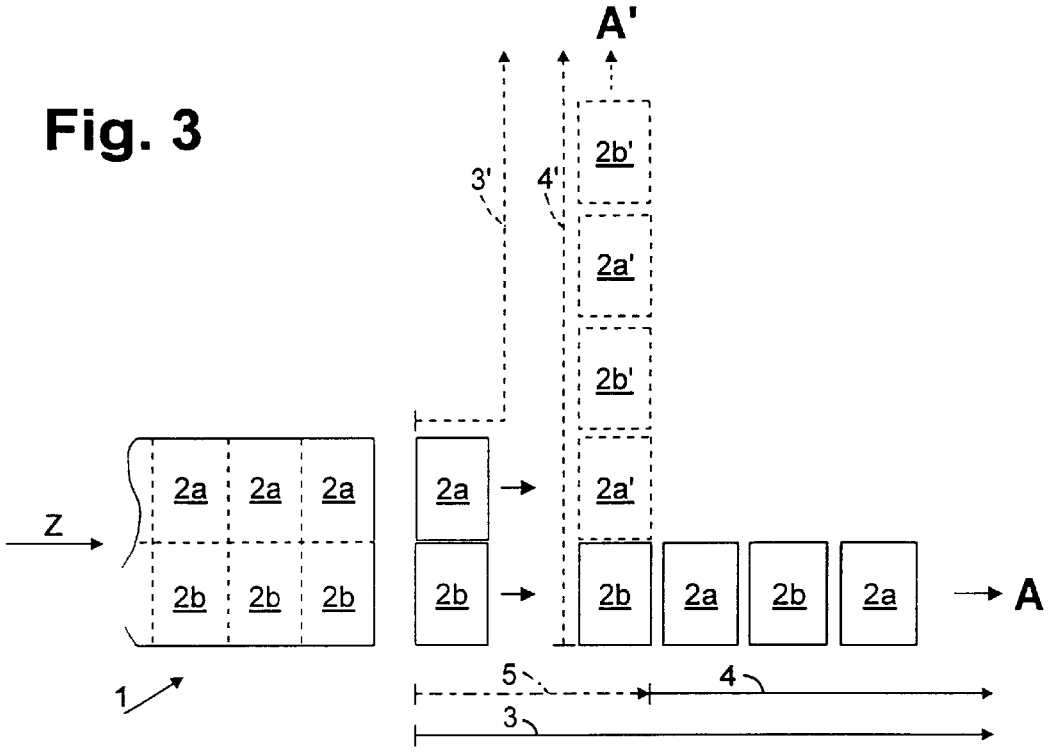
FIG. 3 is a diagrammatic illustration of the process according to the invention during the processing of a paper web cut crosswise and lengthwise.

FIG. 3 shows a supplied paper web 1, which is cut crosswise and lengthwise to form individual sheets. Thus, during conveyance, web 1 passes through a cutting device not shown here, which cuts individual sheets 2*a*, 2*b* such that they are distributed to two rows. The individual sheets 2*a*, 2*b* remain in the same position during the continued conveying route 3 and are supplied one after another, in a row, to further processing location A. In this case, individual sheets 2*a* are displaced to the side on conveying route 5, and are supplied via conveying segment 4 to the location for further processing.

Alternatively, the individual sheets 2*a*, 2*b* can be deflected according to FIG. 3 by 90°, so that they follow each other sequentially in a lengthwise format, thereby following a conveying segment 4' that deviates by 90° from the feed direction of web 1.

Figure 4:
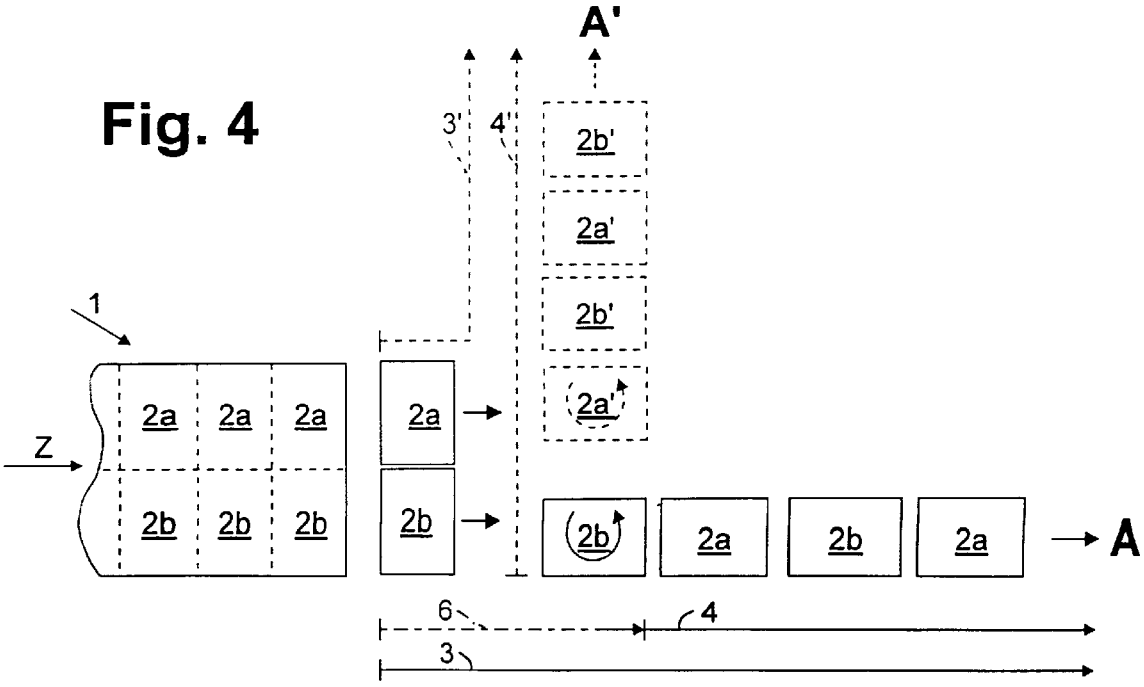
FIG. 4 is a diagrammatic illustration of an alternative course of action for the processing of a paper web cut crosswise and lengthwise.

In contrast to FIG. 3, FIG. 4 illustrates a course of action where the individual sheets 2*a*, 2*b* are additionally turned, relative to their position, and are subsequently supplied one after another and in a row to the further processing location A.

Figure 5:
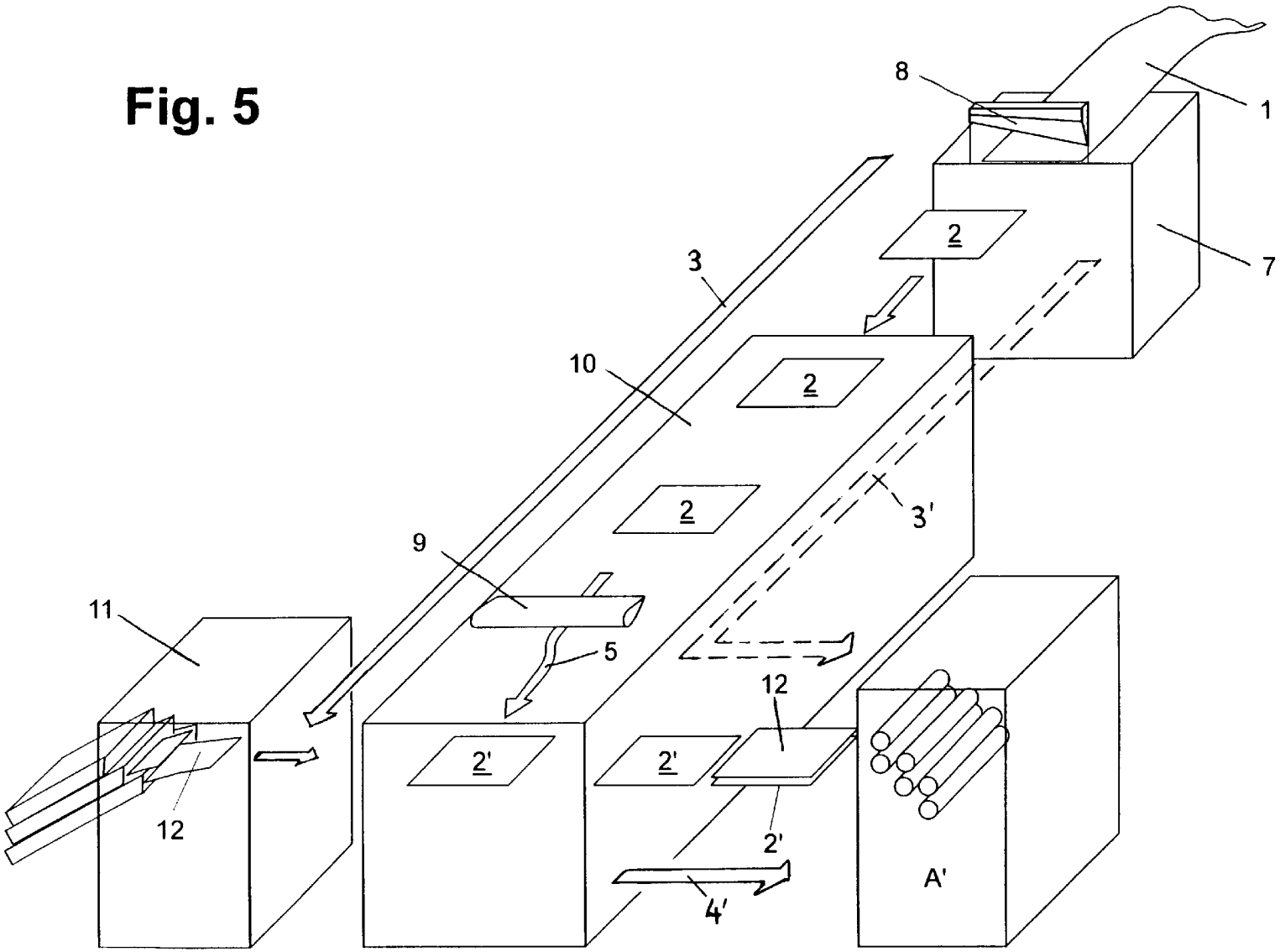
FIG. 5 is an arrangement for implementing the process according to the invention based on FIG. 1.

FIG. 5 shows, in part, an arrangement where a printed-on paper web 1 is fed to a cutting device 7. Cutting device 7 shown here permits the cutting of paper web 1 with the help of a moving knife 8 that is arranged crosswise to the feeding direction of the web. Following cutting device 7, individual sheets 2 pass through a diverter 9, which directs these sheets optionally to conveying route 5 (below diverter 9) or conveying route 6 (above diverter 9) (see FIG. 6). The purpose of conveying route 5 is to maintain the position of the individual sheets 2' and to deflect them at an angle to the continued conveying route 3'.

In FIG. 5 further processing station A' is depicted as a folding device for making, for example, a parallel fold. Additionally, an alignment device 10 can be arranged on the continued conveying route 3, 3' in front of the diverter 9. The alignment device is designed to be adjustable and can be put into operation or taken out of operation. Alignment devices are well known and are therefore not described here. In order to supply supplements or envelopes 12, a respective feeder 11 is coordinated with the junction for conveying routes 5, 6, which feeder supplies supplements 12 to the flow of individual sheets.

Figure 6:
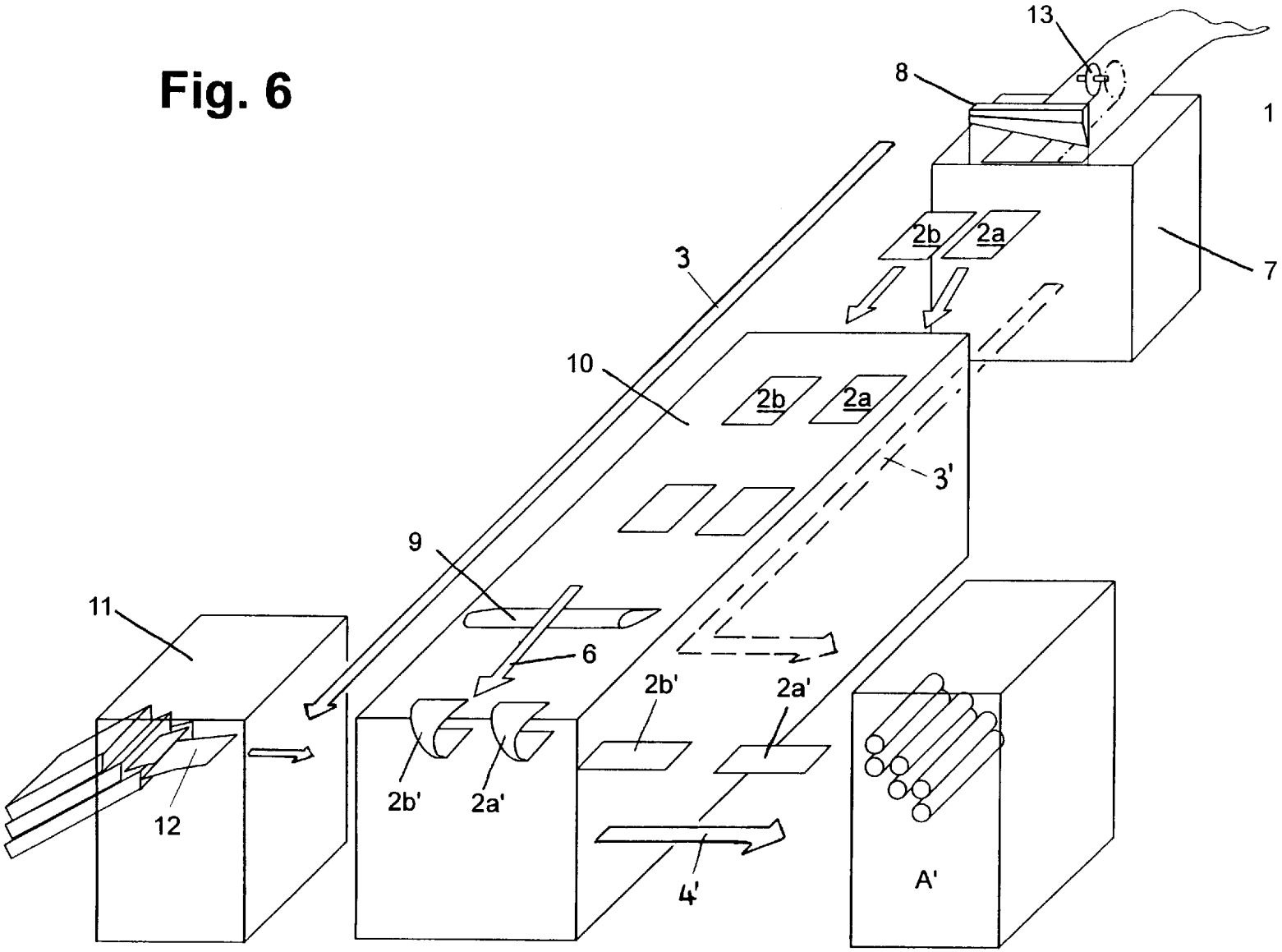
FIG. 6 is an arrangement according to FIG. 4 of the process.

FIG. 6 shows an arrangement, again with a digital printing system not being shown, which in contrast to FIG. 5, paper web 1 is cut crosswise as well as lengthwise by cutting device 7, so that several, in this case two, individual sheets 2*a*, 2*b* are created and distributed over the width of the paper web 1. A fixed or a driven knife 13 is provided for the lengthwise cut. The position of diverter 9 also deviates from that in FIG. 5, so that the individual sheets 2*a*, 2*b* are conveyed side by side to the conveying route 6 on the top of diverter 9. On the conveying route 6, the individual sheets 2*a*', 2*b*' are turned in pairs, with a simultaneous change in the direction, and are conveyed such that they follow each other sequentially in a row.

The invention has been described in detail with respect to preferred embodiments, and it will now be apparent from the foregoing to those skilled in the art, the changes and modifications may be made without departing from the invention in its broader aspects, and the invention, therefore, as defined in the appended claims, is intended to cover all such changes and modifications as to fall within the true spirit of the invention.

What is claimed is:

1. A process for manufacturing printed products comprising: feeding a web of paper in a feeding direction; printing on the web of paper in accordance with a predetermined page sequence for the printed product;

cutting of the web into individual sheets, the cutting step selected from at least one of a) crosswise and b) crosswise and lengthwise and including cutting the individual sheets several times lengthwise;

conveying the cut sheets on a continued conveying route for further processing;

selectively turning the individual sheets cut from the web by 90° in position relative to the feeding direction of the web; and conveying the cut sheets one after another, in one or several rows, via a joint conveying segment of the continued conveying route to a further processing location.

2. A process according to claim 1, further comprising conveying the cut sheets in a direction deviating by 90° from the feeding direction via the joint conveying segment of the continued conveying route.

3. A process according to claim 2, further including supplying at least one of a supplement and an envelope after the cutting of the web into individual sheets.

4. A process according to claim 3, including sorting the individual sheets to follow one after another and wherein the supplying step includes supplying the at least one of the supplement and the envelope during or following the sorting of the individual sheets to follow one after another.

5. A process according to claim 2, further including supplying at least one of a supplement and an envelope during the 90° deviation in the continued conveying route of the individual sheets.

6. A process according to claim 3, further including forming a gap between the successively conveyed individual sheets for supplying the at least one of the supplement and the envelope.

7. A process according to claim 1, wherein the cutting of the web includes cutting one of the web and the individual sheets lengthwise before, during or after the crosswise cut is made.

8. A process according to claim 7, further including bringing the lengthwise cut individual sheets together to follow each other sequentially in a single row.

9. A process according to claim 1, further including discharging the conveying segment of the continued conveying route into a folding device that forms a parallel fold.

10. A process according to claims 1, aligning the individual sheets leaving the conveying segment of the continued conveying route such that they are guided on a side.

11. A process according to claim 1, wherein the turning step includes rotating the individual sheets by turning them over with a simultaneous change in the conveying direction.

12. A process according to claim 1, wherein the turning step includes deflecting the individual sheets to effect the deviation of the continued conveying direction from the web feeding direction.

13. An apparatus for manufacturing printed products by printing on a web of paper in accordance with a predetermined page sequence for the printed product, the web being fed in a feeding direction comprising:

a cutting device for selectively cutting the web of paper into individual sheets one of a) crosswise and b) crosswise and lengthwise, the cutting device being installed after a printing machine supplied with a paper web, the web being fed in a feeding direction;

a continued conveying route connected to the cutting device for conveying the cut sheets for processing by a further processing device;

a joint conveying segment of the continued conveying route for conveying the cut sheets one after another, in at least one row, to a further processing location;

a diverter located upstream on the continued conveying route for forming two conveying routes which discharge into a downstream conveying segment of the continued conveying route;

a first means in one of the two conveying routes for deflecting movement of the individual sheets 90° relative to the feed direction; and a second means in the other conveying route of the two conveying routes for turning over the individual sheets with a simultaneous change in the conveying direction, wherein the two conveying routes are arranged one above another.

14. The arrangement according to claim 13, and further including an alignment device installed in front of the diverter for aligning the individual sheets.

15. The arrangement according to claim 13, wherein the conveying segment comprises an angular roller table having a side with a guide stop for realigning the individual sheets.

16. The arrangement according to claim 13, and further including a sheet feeder for supplements or envelopes arranged at a downstream junction for the two conveying routes.

* * * * *